US005230283A

United States Patent [19]

Kobayashi

[11] Patent Number: 5,230,283

[45] Date of Patent: Jul. 27, 1993

[54] PRINT HAMMER POSITION CONTROL DEVICE

[75] Inventor: Norio Kobayashi, Nagoya, Japan

[73] Assignee: Brother Kogyo Kabushiki Kaisha, Aichi, Japan

[21] Appl. No.: 900,962

[22] Filed: Jun. 18, 1992

[30] Foreign Application Priority Data

Jun. 19, 1991 [JP] Japan ..... 3-147523

[51] Int. Cl.[5] ..... B41J 9/38

[52] U.S. Cl. ..... 101/93.30; 400/157.3; 400/391.2

[58] Field of Search ..... 400/385, 387, 388, 389, 400/390, 391.2, 391.4, 392, 157.2, 166; 101/93.30, 93.31; 318/461, 470; 388/804, 811, 819, 829, 831; 324/166, 173, 174

[56] References Cited

U.S. PATENT DOCUMENTS 3,850,098 11/1974 Morohashi ..... 101/93.31

3,929,067 12/1975 Nishikawa ..... 101/93.30

*Primary Examiner*—David A. Wiecking

*Assistant Examiner*—Steven S. Kelley

*Attorney, Agent, or Firm*—Kane, Dalsimer, Sullivan, Kurucz, Levy, Eisele and Richard

[57] ABSTRACT

A print hammer is moved toward a printwheel and impinges thereon to thus make a character impression on a sheet of paper supported on a platen. The print hammer is moved in accordance with rotations of a cam which in turn is rotated by a motor. An encoder disk formed with a plurality of slits in the outer circumference thereof is attached to the drive shaft of a motor. A photocoupler including an LED and a photosensor is provided in association with the encoder disk to detect the rotational speed of the motor. The speed and position control of the print hammer are carried out based on output pulses from the photosensor. Before the print hammer reaches a pre-impact position, only up-going pulses are used for the control. After passing the pre-impact position and until reaching a post-impact position, the speed and position control of the print hammer are carried out based on both the up-going and down-going pulses.

7 Claims, 7 Drawing Sheets

PRINT HAMMER POSITION CONTROL DEVICE

BACKGROUND OF THE INVENTION

1. Field of the Invention

The present invention generally relates to a print hammer control device, and more particularly to a device for controlling print hammer speed immediately before a print hammer impinges on a print wheel.

2. Description of the Prior Art

There has been known printing devices, such as print wheel electric typewriter, capable of printing and erasing characters. Such a printing device has a carriage on which print hammer, print wheel, ink ribbon, erase ribbon and their drive mechanisms are mounted. In the electric typewriter, printing is carried out with a print hammer. The print hammer is moved at a high speed by a print hammer drive mechanism so as to impinge on the print wheel, thereby making a character impression on a sheet of paper. In such a printing device, it is required that the print wheel be applied with a predetermined pressure to maintain a standard level of print quality. To this end, both print hammer position and print hammer speed are detected by a combination of a computer and an encoder so that the print hammer speed is controlled based on the detected data.

However, in order to detect the speed and position of the print hammer during a high speed movement thereof, a high resolution encoder and a high performance CPU are required. The high resolution encoder is necessary to obtain precise data, and the high performance CPU is necessary because the CPU has to accomplish the speed control of the print hammer within an extremely short period of time immediately before the hammer impinges on the print wheel. A problem then arises due to expense of the complex equipment needed.

SUMMARY OF THE INVENTION

The present invention has been made to solve the above-mentioned problem, and accordingly it is an object of the invention to provide a print hammer control device which reliably carries out speed control of a print hammer without requiring a high resolution sensor and a high performance CPU.

To achieve the above and other object, the present invention provides, as shown in FIG. 1, a print hammer control device for controlling a print hammer (M2) driven by a motor (M1) having a drive shaft, the print hammer (M2) being moved toward a printwheel and impinged thereon to thus make a character impression on a sheet of paper. The device includes detecting means (M3) for detecting a rotational speed of the motor (M1) and producing pulses corresponding to the rotational speed of the motor (M1). The pulses produced therefrom are defined by up going pulses and down-going pulses. The device further includes first control means (M4) which is responsive to selective one of the up-going and down-going pulses produced from the detecting means (M3) and controls movement of the print hammer (M2) which has not reached a predetermined position immediately before the print hammer (M2) impinges on the printwheel. There is provided decision means (M5) for deciding that the print hammer (M2) has reached the predetermined position, and second control means (M6) responsive to both the up-going and down-going pulses produced from the detecting means (M3) for controlling 10 the print hammer (M2) when the decision means (M5) decides that the print hammer (M2) has reached the predetermined position.

In the print hammer control device of this invention, the print hammer (M2) is driven by the motor (M1) and the movements of the print hammer (M2) are detected by the detecting means (M3). Based on the detected data, the movements of print hammer M2 are controlled. The second control means (M4) controls the speed of the print hammer (M2) based on both up-going and down-going pulses when the decision means (M5) decides that the print hammer (M2) has reached the predetermined position immediately before the print hammer (M2) impinges the printwheel.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

A preferred embodiment of the present invention will be described with reference to the accompanying drawings. The preferred embodiment is directed to an electric typewriter in which a single d.c. motor is used as a driving source for printing, winding of an ink ribbon, erasing, and winding of an erase ribbon. For carrying out other operations, such as moving of a carriage, another motor is used.

Figure 1:
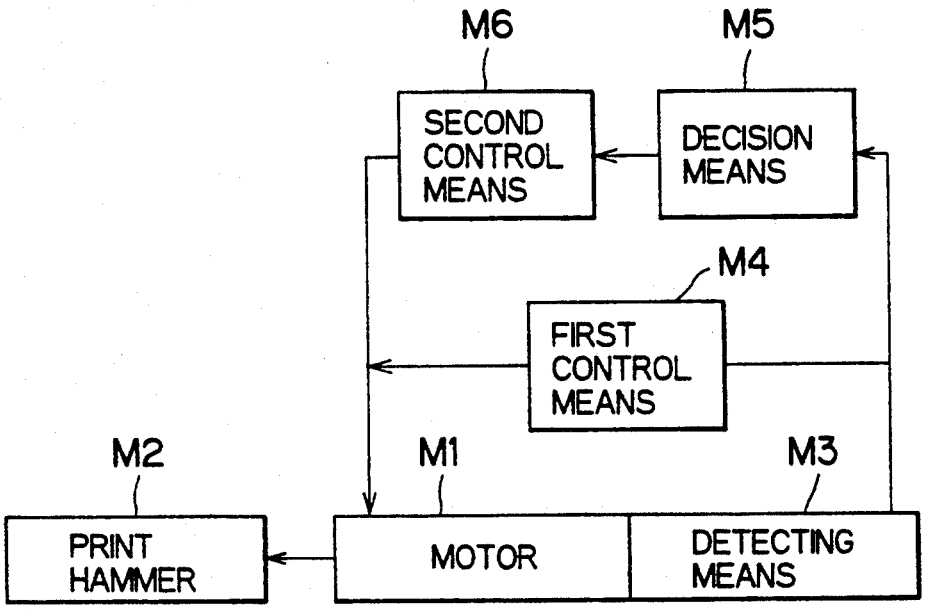
FIG. 1 is a block diagram showing an arrangement of the present invention.
Figure 2:
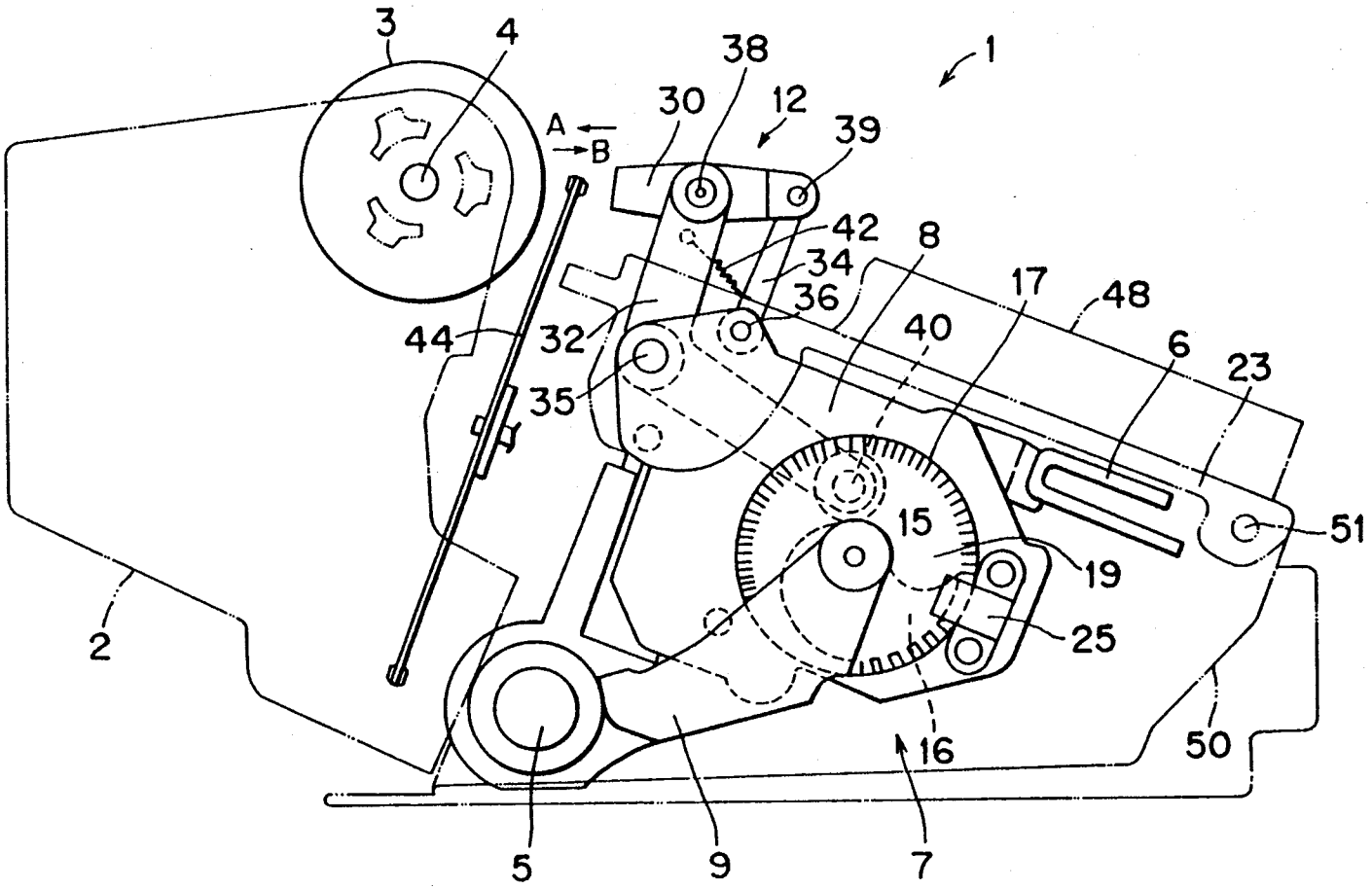
FIG. 2 is a side view showing the internal mechanism of a typewriter according to an embodiment of the invention.

As illustrated in FIG. 2, side walls (frame) 2 are provided at both ends of the interior of a typewriter casing. A platen 3 is rotatably supported between the side walls 2 to be rotatable about its own shaft 3. A driven gear (not shown) is coaxially coupled to the left side of the platen spindle 4 and is rotated by a platen drive motor 10 (see FIG. 4) and a drive mechanism (not shown) operatively coupled thereto. Further, a guide rod 5 and a guide member 6 having a U-shaped cross-section are supported between the side walls 2 in parallel to the platen 3. A carriage 7 is slidably movably supported on the guide rod 5 and the guide member 6. The carriage 7 has a carriage body 11 made up of main frames 8 and a support member 9. The main frames 8 are a pair of plate members disposed in spaced apart and in parallel to each other. The main frames 8 are supported by the support member 9 to be horizontally movable along the guide rod 8 and rotatable about the guide rod 8. The carriage 7 is coupled via a drive wire to a carriage drive mechanism (not shown) which in turn is coupled to a carriage drive motor 13 (see FIG. 4), and is reciprocally moved back and forth along the platen 3.

Figure 3:
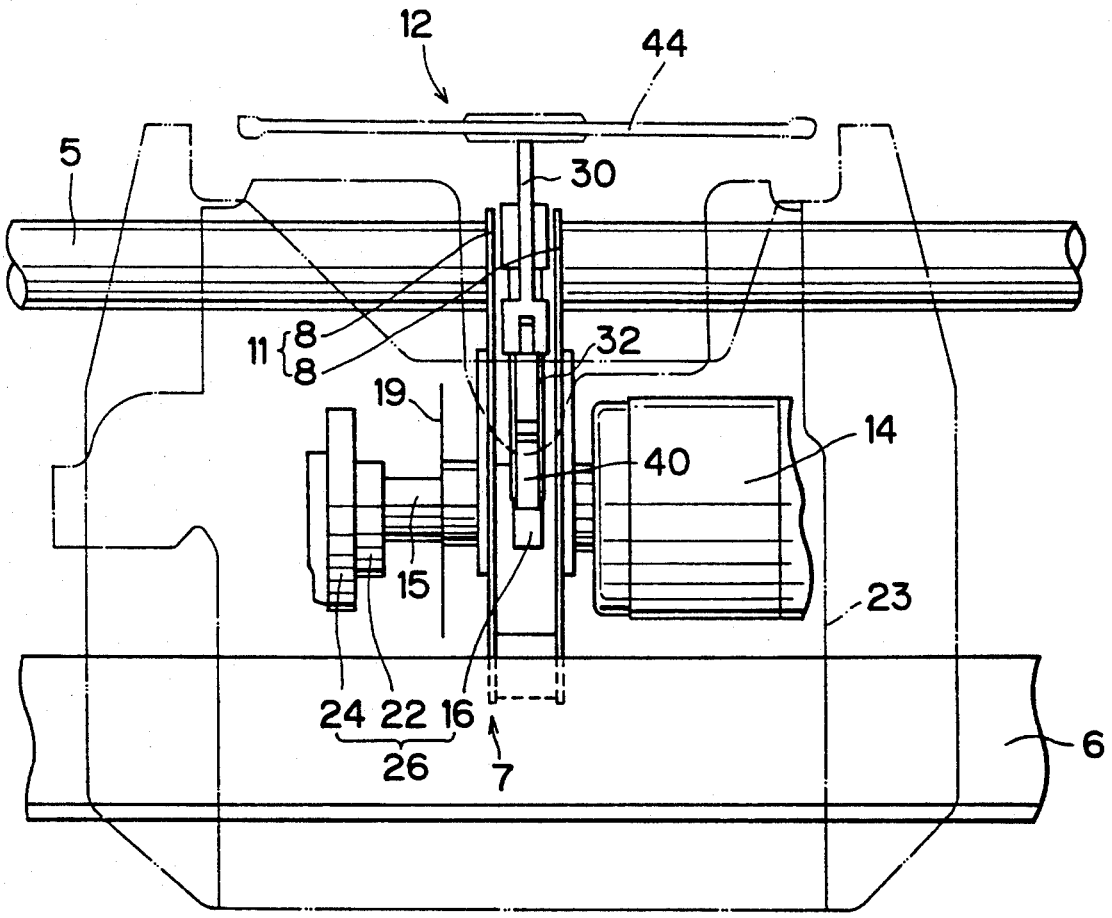
FIG. 3 is a plan view showing the internal mechanism of the typewriter according to the embodiment of the invention.

Referring next to FIG. 3, a d.c. print motor 14 is supported on the rightside main frame 8 and a drive shaft 15 of the print motor 14 passes through the two main frames 8 and extends to the left. A printing cam 16 having a whirl-shaped side view is attached to the drive shaft 15 of the print motor 14 in a position between the main frames 8. Further, an encoder disk 19 formed with a plurality of equipitch slits 17 in the outer circumference thereof, a ribbon supply cam 22 for intermittently feeding the ink ribbon, and raising cam 24 for elevating a holder member 23 to an erase position are coupled to the drive shaft 15. The printing cam 16, ribbon supply cam 22 and raising cam 24 constitute a cam unit 26, and the ribbon supply cam 22 and the raising cam 21 are integrally formed.

As shown in FIG. 2, a photocoupler is provided in association with the encoder disk 19. Specifically, a light emitting diode (LED) is disposed at one side of the encoder disk 19 and a photosensor 25 is disposed at opposite side of the encoder disk 19. The photosensor 25 receives light emitted from the LED and passed through the slit 17. Based on the output from the photosensor 25, the rotational speed of the print motor 14 and the moving speed of the print hammer 30 are computed.

A V-shaped lever 32 is provided between the main frames 8 to be rotatable about the center portion of the lever 32 attached by a pin 35. A link 34 is provided to be rotatable about the lower portion thereof by a pin 36. The print hammer 30 is attached to the upper portions of both the lever 32 and link 34 via pins 38 and 39, respectively. While being supported at four locations by the pins 35, 36, 38 and 39, the print hammer 30 is movable in directions of arrows A and B.

A cam follower 40 is rotatably supported at the lower portion of the lever 32. A coil spring 42 is stretched between the upper portion of the lever 32 and the lower portion of the link 34 so that the cam follower 40 is constantly in abutment with the surface of the cam 16. A printwheel 44 is disposed between the platen 3 and the print hammer 30. The printwheel 44 is rotated by a wheel drive motor 46 (see FIG. 4) and a wheel drive mechanism provided in association therewith (not shown). An ink ribbon cassette 48 houses an ink ribbon therein. Reference numeral 50 denotes an auxiliary frame which is movable along the axial direction of the platen 3. The holder member 23 mounting a ribbon cassette 48 thereon is supported by a support shaft 51 on the auxiliary frame 50 to be pivotally movable about the support shaft 51.

Figure 4:
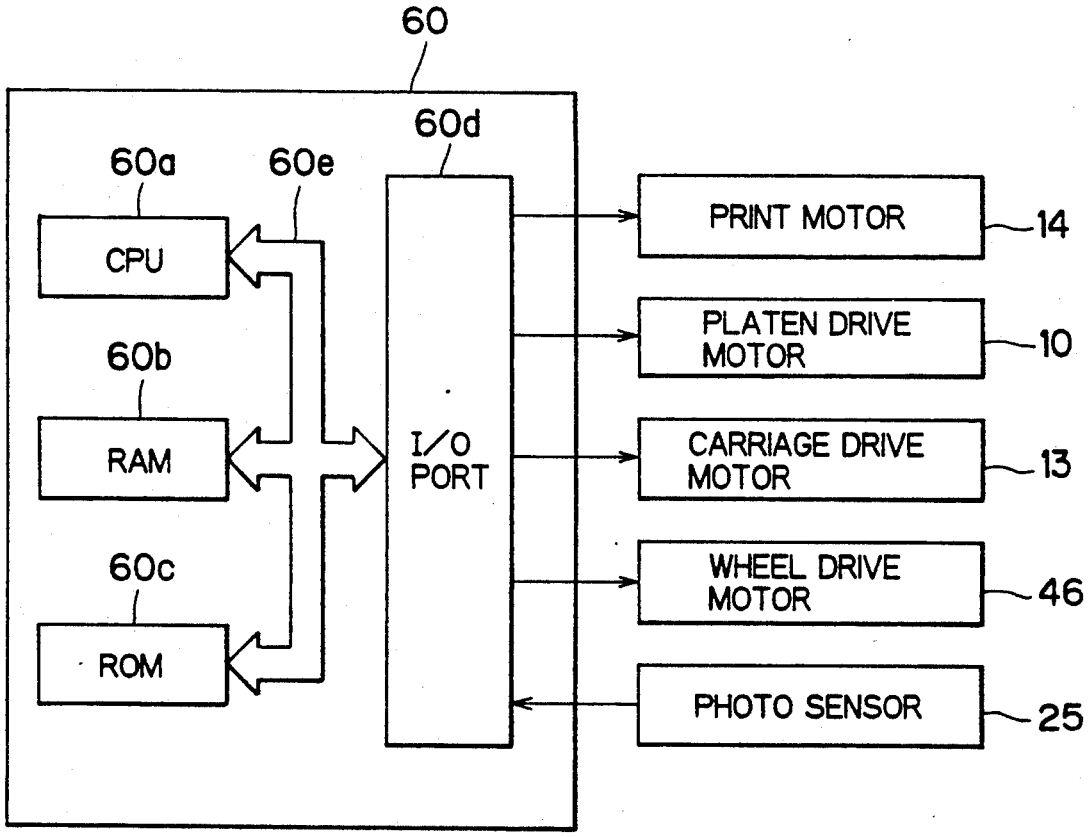
FIG. 4 is a block diagram showing an electrical control unit according to the embodiment of the invention.

Referring next to FIG. 4, an electronic control unit for controlling the operations of the typewriter 1 will be described. The electrical control unit (ECU) 60 includes a central processing unit (CPU) 60*a*, a random access memory (RAM) 60*b*, a read-only memory (ROM) 60*c*, and input/output port 60*d*, which are mutually connected by a bus line 60*e*. The input/output port 60*d* is also connected to the platen drive motor 10, the carriage drive motor 13, the wheel drive motor 46, the print motor 14, and the photosensor 25.

Figure 5:
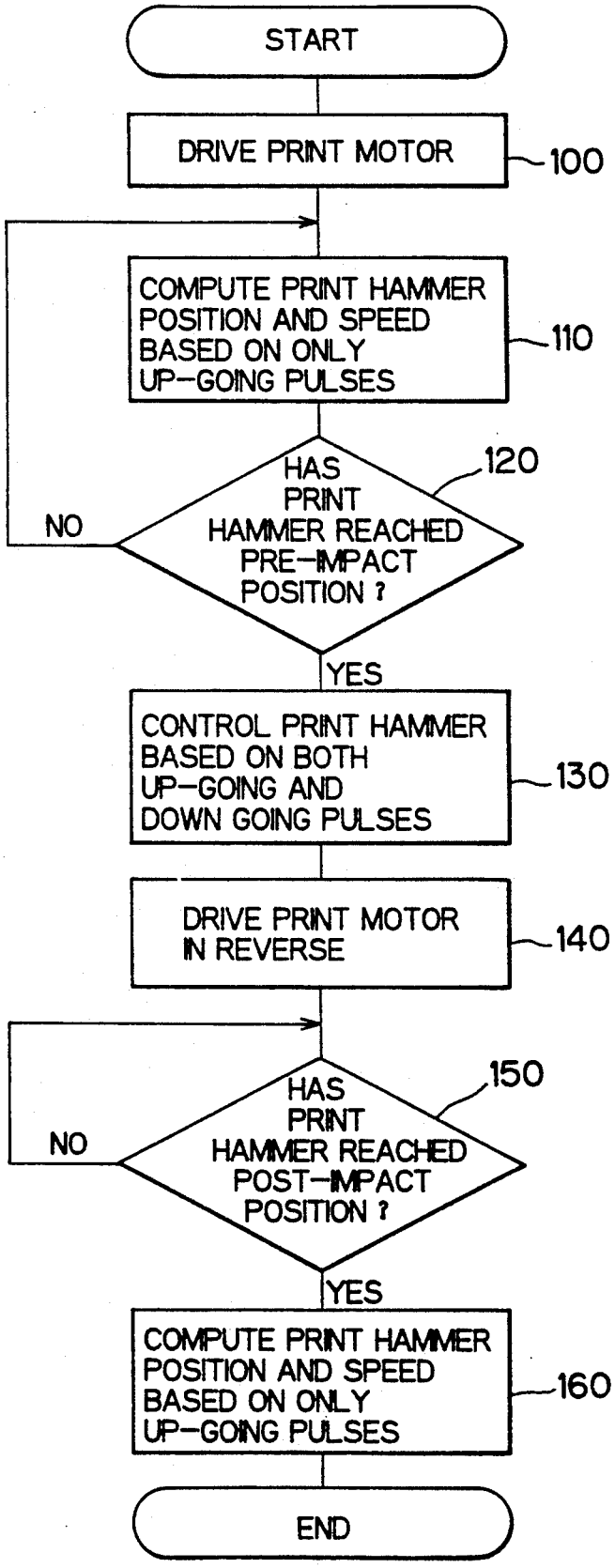
FIG. 5 is a flow chart illustrating a print hammer speed control according to the embodiment of the present invention.
Figure 6:
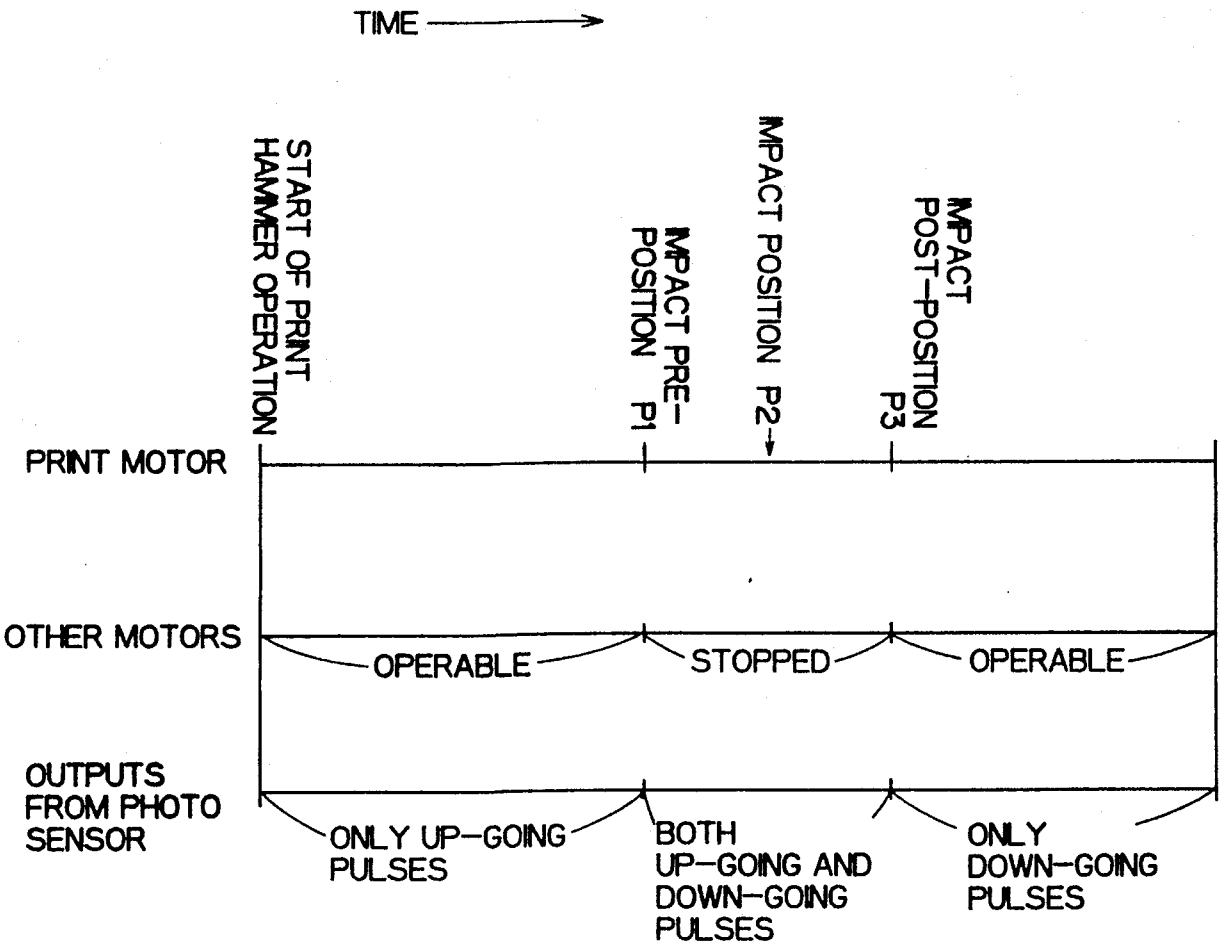
FIG. 6 is a timing chart showing print hammer operations at various timings.

Referring next to FIGS. 5 through 7, the print hammer speed control operation to be carried out by the ECU 60 will be described.

Figure 7A:
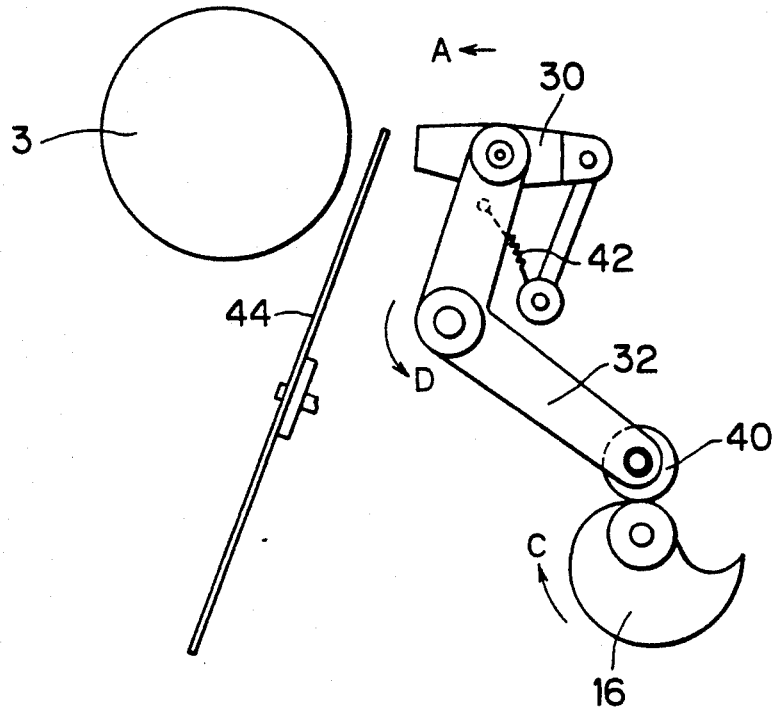
FIGS. 7A and 7B are explanatory diagrams showing print hammer operations.

First, the print motor 14 is driven in step 100 to thereby rotate the print cam 16 in the direction indicated by an arrow C in FIG. 7A. The lever 32 then rotates in the direction indicated by an arrow D by virtue of the cam follower 40. Thus, the print hammer 30 moves in the direction indicated by an arrow A against the biasing force of the coil spring 42. At this time, since print motor 14 is driven at a predetermined rotational speed, the print hammer 30 also moves at a speed corresponding to the rotational speed of the motor 14. The encoder disk 19 rotates together with the motor 14. In step 110, the position and speed of the print hammer 30 are computed using only the up-going pulses produced from the photosensor 25. That is, the position of the print hammer 30 is computed by counting the number of up-going pulses produced after the photosensor 25 has detected a reference slit (not shown) of the encoder disk 19. The reference slit is formed radially inwardly of the encoder disk 19 and another pair of a light emitting diode and a photosensor are provided to detect the position of the reference slit. When the print hammer is fully retracted and is in a home position, the motor or the encoder disk 19 is in a position to detect the reference slit.

In step 120, it is determined whether the print hammer position computed using the up-going pulses is in coincidence with a designated impact start position P1. If affirmative decision is made in step 120, the routine proceeds to step 130. In step 130, both the up-going and down-going pulses are utilized for computing the speed and position of the print hammer 30 in an interval smaller than the initial control. Based on the data obtained through the computation, the rotational speed of the print motor 14 is controlled. Stated another way, precise speed control of the print hammer 30 is carried out to thereby make the impact pressure constant. In other words, more precise speed control of the print hammer 30 is carried out and the impact pressure of the print hammer 30 on the platen 3 is made constant.

At this time, since the platen 3 and the carriage 7 are stopped, there is no need to provide drive control for the platen drive motor 10, the carriage drive motor 13, and wheel drive motor 46. Hence, the CPU 60*a* has a capability of controlling these motors 10, 13 and 46, thus precise processing can be achieved with the use of both the up-going and down-going pulses. In the state where the print hammer 30 is in a position before reaching the impact start position P1, 50% processing capability of the CPU 60*a* may be allocated to the control of the print hammer 30 and the rest of 50% processing capability of the CPU 60*a* may be allocated to the control of the motors 10, 13 and 46. In the state where the print hammer 30 has reached the impact start position P1, a full processing capability of the CPU 60*a* may be used for the control of the print hammer 30.

Figure 7B:
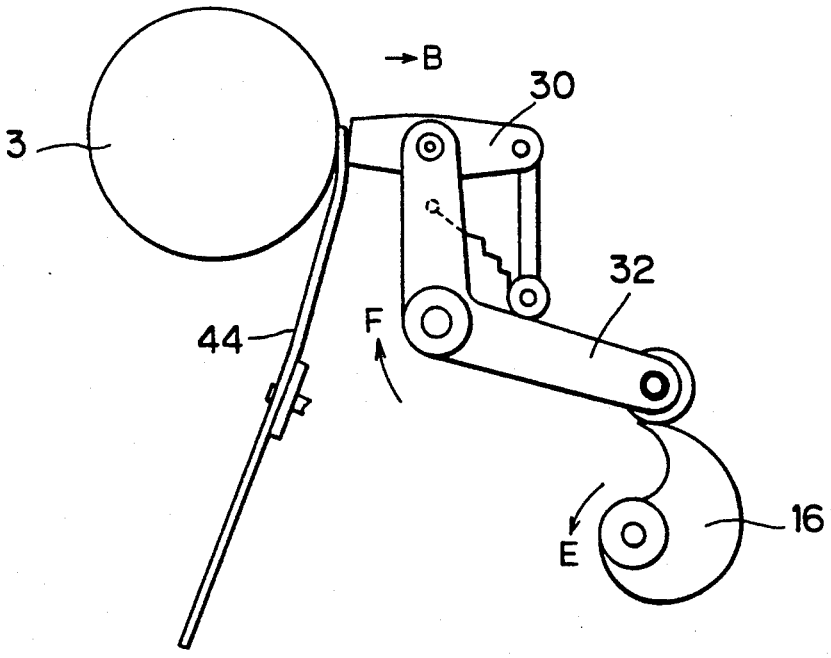

As shown in FIG. 7B, after the print hammer 30 impinges on the printwheel 40 to thus make a character impression on the sheet of paper held on the platen 3, the print motor 14 is rotated reversely in step 140. More specifically, the print cam 16 rotated in the direction of an arrow E and the lever 32 is rotated in the direction of arrow F, thus print hammer 30 is retracted in the direction of arrow B. In step 150, if a determination is made that the print hammer 30 has reached the position P3 immediately after impact, then routine proceeds to step 160. In step 160, only the up-going pulses are used for computing the position and moving speed of the print hammer 30 in a longer time interval, whereupon the routine is ended.

As described, according to the embodiment of the present invention, when the print hammer 30 is between pre-impact position P1 and post-impact position P3 where the CPU 60*a* is only expending its processing capacity for the control of the motors 10, 13 and 46 (other than print motor 14), the precise speed control of the print hammer 30 is carried out based on both the up-going and down-going pulses. On the other hand, when the print hammer 30 is other than the above-mentioned region, only the up-going pulses are utilized for carrying out control. Accordingly, the speed of the print hammer 30 immediately before and after the impact can be precisely controlled, so that the impact pressure of the print hammer 30 can be made substantially constant, whereby high quality printing with no variations can be achieved. In addition, this precision control is only carried out in the interval when the CPU 60*a* has spare processing capacity as other motors are stopped, and since the frequency of the processing is averaged out over the whole operating time, the high performance CPU 60*a* need not be used and sufficiently precise control is possible giving the advantage of reduced costs. Further, high resolution encoders and sensors need not be used yet precise control is achieved.

While the preferred embodiment of the present invention has been described, it can be understood for a person skilled in the art that a variety of changes and modifications may be made without departing from the scope of the invention. For example, during the intervals where precision control is not necessary, down-going pulses may be used in place of up-going pulses. Use of both the up-going and down-going pulses may be continued after the impact of the print hammer.

As is clear from the foregoing description, when the print hammer is determined to have reached a point just prior to impact, the print hammer is controlled based on both the up-going and down-going pulses. Therefore, a high resolution sensor and high performance CPU are not necessary as the print hammer position and speed are accurately detected and precise control of print hammer speed and position can be carried out. Therefore, the advantages of a simplified mechanism structure and reduced costs are obtained.

What is claimed is:

1. A print hammer control device for controlling a print hammer driven by a motor having a drive shaft, the print hammer being moved toward a printwheel and impinged thereon to thus make a character impression on a sheet of paper, the device comprising:

detecting means for detecting a rotational speed of the motor and producing pulses corresponding to the rotational speed of the motor, the pulses being defined by pulses with an up-going edge and pulses with a down-going edge;

first control means responsive to selective one of the up-going edge and down-going edge pulses produced from said detecting means, for controlling movement of the print hammer which has not reached a predetermined position immediately before the print hammer impinges on the printwheel;

decision means for deciding that the print hammer has reached the predetermined position; and second control means responsive to both the up-going and down-going pulses produced from said detecting means, for controlling the movement of the print hammer when said decision means decides that the print hammer has reached the predetermined position.

2. The device according to claim 1, further comprising third control means responsive to selective one of the up-going and down-going pulses produced from said detecting means, for controlling the movement of the print hammer moving away from the printwheel upon making the character impression on the sheet of paper.

3. The device according to claim 2, wherein said detecting means comprises:

an encoder disk attached to the drive shaft of the motor to be rotatable therewith, said encoder disk being formed with a plurality of slits in a circumference thereof;

light emitting means disposed at one side of said encoder disk for emitting light; and light receiving means disposed at another side of said encoder disk to receive light emitted from said light emitting means and passed through the slits.

4. The device according to claim 3, wherein said second control means controls a moving speed of the print hammer.

5. The device according to claim 1, wherein said second control means controls the movement of the print hammer after the print hammer makes the character impression on the sheet of paper.

6. The device according to claim 5, wherein said detecting means comprises:

an encoder disk attached to the drive shaft of the motor to be rotatable therewith, said encoder disk being formed with a plurality of slits in a circumference thereof;

light emitting means disposed at one side of said encoder disk for emitting light; and light receiving means disposed at another side of said encoder disk to receive light emitted from said light emitting means and passed through the slits.

7. The device according to claim 6, wherein said second control means controls a moving speed of the print hammer.

* * * * *